United States Patent [19]

Casull

[11] Patent Number: 5,048,216

[45] Date of Patent: Sep. 17, 1991

[54] BARREL FORCING CONE BUSHING AND TOOLING

[76] Inventor: Richard J. Casull, P.O. Box 243, Freedom, Wyo. 83120

[21] Appl. No.: 522,666

[22] Filed: May 14, 1990

[51] Int. Cl.[5] ..... F41A 21/00

[52] U.S. Cl. ..... 42/76.01; 42/59

[58] Field of Search ..... 42/59, 76.01

[56] References Cited

U.S. PATENT DOCUMENTS

| | | | |
|---|---|---|---|
| 325,878 | 9/1885 | Tyler | 42/59 |
| 1,965,637 | 7/1934 | Frederich et al. | 42/59 |
| 2,981,023 | 4/1961 | Sergay | 42/59 |
| 3,136,084 | 6/1964 | Charron | 42/59 |
| 4,660,312 | 4/1987 | A'Costa | 42/76.01 |

*Primary Examiner*—Richard W. Wendtland
*Attorney, Agent, or Firm*—M. Reid Russell

[57] ABSTRACT

A barrel forcing cone bushing for a revolver adapted for firing high intensity ammunition, which bushing is provided for installation in the weapon frame in abutting and sealing engagement to the throat or lead end of the revolver barrel. The bushing is installed and removed utilizing tooling of the invention that consists of a sleeve that is tapped longitudinally to receive a screw turned therein, which sleeve includes, on its end opposite to its screw receiving end a bevel gear that is formed around the sleeve end inside that is for meshing with a like bevel gear formed around the bushing end opposite to the bushing barrel engaging end. The screw and sleeve are installed in the weapon frame, and the sleeve turned to where the screw is stationary in the frame, against the firing pin side of the cylinder compartment, the sleeve will extend therefrom and, when turned, turns the bushing into the barrel receiving bore of the frame. The threads of the screw, sleeve, bushing, barrel and barrel-receiving bore of the frame are identical.

7 Claims, 1 Drawing Sheet

BARREL FORCING CONE BUSHING AND TOOLING

BACKGROUND OF THE INVENTION

1. Field of the Invention

This invention relates to firearms and in particular to large caliber handguns, revolvers, or rifles that utilize large cartridges or shells having high intensity loading. More specifically, the invention relates to an improved bushing for protecting the throat or lead end of a barrel of such a high intensity revolver and tooling for its installation.

2. Prior Art

Guns and particularly revolvers of various sizes and shapes are well known in the prior art. Recently in particular, large caliber revolvers have been introduced which utilize large cartridges or shells having high intensity loading, and a number of inventions have been developed including barrel bushings such revolvers for increasing barrel life and as gas check devices for such revolvers.

An early U.S. Pat. No. 325,878 to J. E. Tyler, shows a gas check arrangement and a number of patents cited in an earlier application of the present invention, entitled "Barrel Bushing for Large Caliber Handgun", Ser. No. 531,075, filed Sept. 12, 1983, now abandoned, are relevant to bushing arrangements generally.

Such high intensity guns as are shown in earlier patents, are capable of projecting a large caliber bullet or projectile from the gun muzzle. A high intensity revolver known as a 454 Casull that is preferred for utilization of the present invention, projects a large caliber bullet at a velocity of 1,500 to 2,000 feet per second or greater. Relatively large quantities of very high pressure gases are produced by the detonation of such high intensity shells or cartridges. Some of which high pressure gases will tend to escape between the revolver cylinder and the barrel, thereby eroding the throat or lead end of the barrel to a much greater extent than has been heretofore experienced with conventional firearms firing lessor intensity shells. Accordingly, where earlier conventional handguns have been capable of firing thousands of rounds of ammunition without serious barrel throat or lead end erosion, the throat or lead end of the barrels of such larger caliber handguns utilizing high intensity loading have been found to be eroded to a point of being essentially inoperable after firing only a comparative few rounds of ammunition.

For providing such needed barrel throat reinforcement the present invention provides a bushing with a straight unrifled bore that can be made of a much harder steel than is appropriate for use in a rifled barrel and for tooling for conveniently and easily installing that bushing as the throat or lead end of the barrel.

SUMMARY OF THE INVENTION

It is therefore a principal objective of the present invention to provide a barrel forcing cone bushing that is separately installable as a throat or lead end of a gun barrel, particularly a large caliber handgun or revolver designed to use ammunition having high intensity loading.

Another object is to provide a relatively inexpensive hard steel bushing formed of a material such as a carbide steel or ceramic which is capable of withstanding the gas pressures developed by the high intensity loading of shells or cartridges, which bushing can be easily mounted to and dismounted from the throat or lead end of a gun barrel.

Another objective of the present invention is to provide a relatively inexpensive bushing, as mentioned above, that can be easily and inexpensively installed or removed without requiring replacement of the barrel of the revolver or handgun.

Still another object of the present invention is to provide tooling for coupling to the bushing for turning it into or out of a barrel receiving bore of the weapon frame as the lead end of the barrel.

The above objectives are achieved in accordance with the present invention by providing a barrel forcing cone bushing for installation at the throat or lead of a barrel of a weapon firing high intensity shells or cartridges. The bushing is not rifled and accordingly can be made of a high strength material such as chrome steel, carbide steel, or a ceramic that is capable of withstanding erosion from the high pressure gases as are produced by the high intensity loading of the ammunition which the weapon fires. Accordingly, the bushing can also be made of heat treated, heat resistance, and/or high abrasive type steel. The bushing is adapted to be fitted into a barrel receiving bore of the revolver or handgun frame so as to be closely positioned against the barrel throat or lead end. The bushing provides a continuation of both the barrel interior wall and its externally threaded end. Because of its hardness the bushing is resistant to erosion from high pressure gases escaping between a revolver cylinder or around a cartridge casing and the bushing. So arranged, the throat or lead end of the barrel, that is made of a soft steel appropriate to be rifled, is no longer subject to the erosive forces of the escaping gases.

The bushing and barrel throat or lead end is stepped to slide over and tightly fit against one another each is turned into the frame barrel-receiving bore, which turning for the bushing, involves a jack screw type tooling of the present invention that also allows for and facilitates removal of the bushing from its seated attitude. The bushing to interact with the tooling includes a bevel gear that is formed around its rear or receiver end to mesh with a bevel gear that is formed around the end of an internally threaded sleeve of the tooling. Which threaded sleeve is arranged to receive a broad headed screw that is turned in the sleeve end opposite to its gear end. The sleeve and the broad head end of the screw are holed laterally to receive bars for individual turning, completing the jack screw type tooling of the present invention. The barrel receiving bore of the frame, the barrel, the bushing and the threaded sleeve and screw of the jack screw all have the same thread. Which thread is as is customarily used in the art for the frame barrel-receiving bore and the externally threaded end of the barrel.

In practice, to install the bushing into the cylinder side of a revolver frame the jacking screw is turned out of the sleeve to where the screw and the broad head top surface engages the firing pin side of the revolver frame and the sleeve mounting the bushing to its end. The respective bevel gears bushing threads are in meshing engagement with the bevel gear threads of the sleeve end, and the barrel has been turned into the opposite end of which barrel receiving bore. With the screw broad head end held stationary, the sleeve is turned to turn the bushing into the frame barrel receiving bore until the respective, of the bushing and barrel end slide over one another. The surfaces closely fitting together in sealing engagement.

Additional objects and features of the present invention will become apparent from the following detailed description taken together with the accompanying drawings.

THE DRAWINGS

Preferred embodiments of the present invention representing the best mode presently contemplated of carrying out the invention are illustrated in the accompanying drawings, in which.

DETAILED DESCRIPTION OF THE INVENTION

Figure 1:
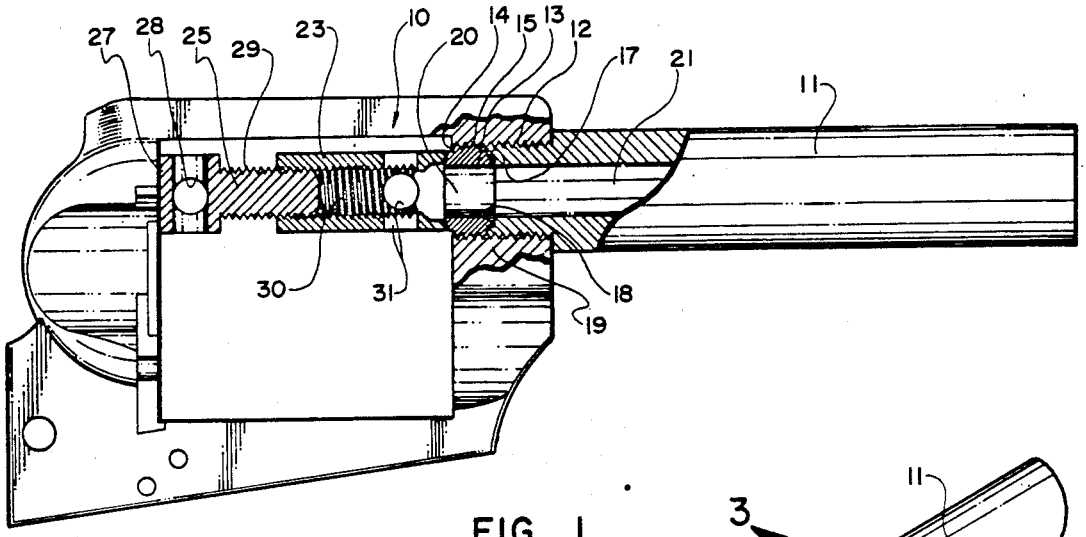
FIG. 1 is a side elevation of a revolver frame, with the barrel shown turned into a forward end of a frame barrel receiving bore and with a barrel forcing cone bushing of the invention shown being turned into the cylinder end of which barrel-receiving bore utilizing tooling of the invention.

FIG. 1 shows a revolver frame 10 in general, with a barrel 11, threaded end 12 turned into a barrel receiving bore 13 of the frame.

The present invention is in an annular barrel forcing cone bushing 15 hereinafter referred to as "bushing" and tooling for installing same. Which bushing 15 is for protecting the throat or lead end of a barrel of a high intensity revolver, or other large caliber weapon, from destructive erosion which would otherwise occur from high pressure gases escaping between the weapon cylinder or around a cartridge casing and the barrel throat or lead end.

The frame 10, as shown, in FIG. 1 is that of a large caliber revolver, such as a 454 Casull, that is capable of firing a large cartridge or shell having a high intensity loading. It should, however, be understood, the barrel forcing cone bushing and tooling of the present invention could be utilized with other makes of revolvers and with other handguns and even rifles, with appropriate modifications to the described tooling, as necessary, within the scope of this disclosure.

The bushing 15 is shown in FIG. 1, positioned within the cylinder side 14 of the barrel receiving bore 13 of the frame 10 of a revolver. The bushing 15 is shown turned into the barrel receiving bore so as to fit against in sealing engagement against a throat or lead end 16 of the barrel 11. Which sealing engagement is provided by the passage of opposing right angle external and internal steps 17 and 18 as are formed, respectively, in the engaging ends of the bushing 15 to have from 0.005 to 0.010 inches to clearance on the outside end thereof between the threaded surfaces, and has a tight face to fit to the end of barrel end 12, providing a barrel bore continuation, as shown best in FIGS. 2 and 3. The opposite step horizontal surfaces have a very small interference of from 0.0005 to 0.001 inches and are to slide over one another as the bushing 15 is turned into a very close fitting engagement within the barrel end 12.

The bushing 15 is externally threaded at 19, over its entire length, which threads exactly conform to the threads 12 of the barrel 11 and with the 0.005 to 0.010 gap for maching tolerance provide a continuation thereof when the bushing and barrel end are turned into the frame barrel receiving bore 13, as shown in FIG. 1. The inner diameter of the cylindrical opening 20 of which bushing 15 is at least the same as the bore 21, fitting tightly thereagainst as a continuation of the bore. The bore surfaces are in coaxial alignment when in the altitude shown in FIG. 1, such that a bullet when fired from a cylinder chamber, not shown, will pass unobstructed through the cylindrical opening 20 of the bushing 15 and into the bore 21 of barrel 11. Shown best in FIG. 2, the barrel 11 bore 21 is rifled while the cylindrical opening 20 in bushing 15 is smooth walled. Accordingly, a bullet passes straight through the bushing 15 and has a spin imparted thereto by the lands and grooves of the rifling in the bore 21. The barrel 11, as it must be rifled, must be manufactured of a steel that is soft enough to have the lands and grooves of rifling cut therein. Whereas, as the bushing cylindrical opening 20 is not rifled, it can be manufactured from a much harder steel as is appropriate for withstanding destructive erosion from high pressure gases. In practice, for the 454 Casull, a very hard 17-4 PH chrome steel is appropriate for use for bushing 15 with the barrel 11 formed of a softer 4-16 PH chrome steel. For other applications of the bushing it can also be formed of a highly heat treated steel, a tungsten carbide steel, or from a ceramic material. Such selected material needs to be extremely hard and resistant to erosion from gases escaping between a revolver cylinder and the bushing 15 or around a cartridge casing. Further, with such bushing 15, as set out in detail below, where the revolver or other large caliber gun has been fired a great number of times wearing the bushing, it is easy and economical to remove the old bushing and replace it with a new one. Even with extensive use, the barrel 11 itself, will not require replacement due to erosion so long as the bushing 15 is at its lead end or throat.

Figure 2:
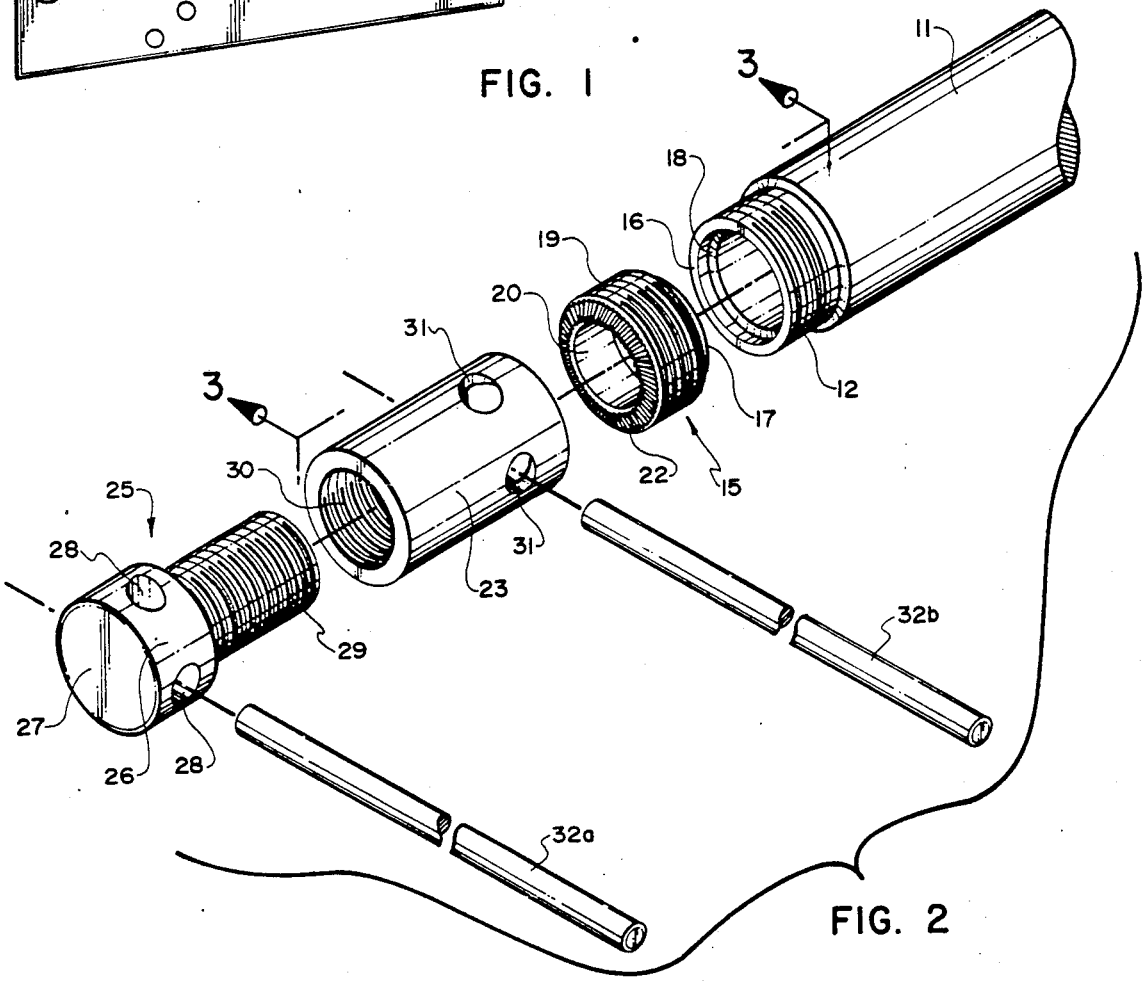
FIG. 2 is an exploded perspective view of the barrel, the barrel forcing cone bushing and the tooling of FIG. 1.
Figure 3:
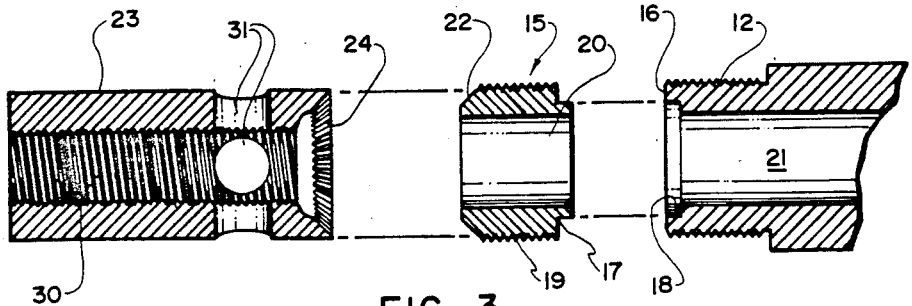
FIG. 3 is an exploded side elevation sectional view taken along the line 3—3 of FIG. 2.

To provide for turning the bushing 15 into and out of the frame barrel-receiving bore 13, a bevel gear 22, is formed around the bushing cylinder side face. Which bevel gear, as shown in FIG. 2, slopes from just above the bushing cylindrical opening 20 towards the barrel engaging end, and terminates just below the level of threads 19. The bushing bevel gear face 22 is for meshing with a bevel gear 24 formed in a recessed end of sleeve 23. The bevel gear formed within of the sleeve is to nest over the bushing end the gear teeth meshing such that turning of the sleeve 23 directly turns the bushing 15.

The sleeve 23 is part of a jacking screw arrangement that also includes a screw 25. Screw 25 has a wide cylindrical head 26 with a flat upper face 27 and is holed laterally at 28 at equal ninety (90) degree points around its circumference. The screw 25 includes a threaded body 29 that is for turning into threads 30 of the sleeve 23. Which sleeve, like screw head 27, is holed laterally at 31 at equal ninety (90) degree points therearound adjacent to the bevel gear end. The respective screw and sleeve holes 28 and 31 are for receiving, as shown best in FIG. 2, round bars **32*a* and 32*b* that are for fitting in holes 28 and 31 for individually holding and/or turning the sleeve 23 and screw 25**, as discussed below.

FIG. 2 shows the bushing 15 turned into the threads of the barrel-receiving bore 13 of frame 10. This turning is provided by turning the sleeve 23, by an operator, not shown, who fits bar **32*b* in sleeve holes 31 and manually turns the sleeve. In that turning the bevel gear 24 sleeve end is in engagement with the bevel gear 22 face end of bushing 15, turning which sleeve thereby turns the bushing also. While turning sleeve 23, the screw 25 is maintained such that its head flat upper face is closely against a firing pin portion or section of the frame 10, by an operator holding the bar 32***a* that has been fitted through aligned holes 28 in the screw cylindrical head. As shown in FIG. 1, with the cylindrical screw head face 27 engaging the pin portion of the frame, within the cylinder compartment, and the sleeve 23 turned to where the combination of screw 25 and sleeve 23 extend across the cylinder compartment of the frame 10, the first thread of the threads 19 at the barrel end of the bushing 15 are in meshing engagement with the end of the threaded barrel receiving bore 13 of the frame. Thereafter, with continued turning of the sleeve 23 the internal threads 30 thereof turned on the screw threads 29 the sleeve is jacked further apart from the screw. In that sleeve turning the meshed bevel gears 24 and 22, of the sleeve and bushing, directly translate sleeve turning into bushing turning into the barrel receiving bore. The bushing is turned therein until the opposing horizontal surfaces of the steps 17 and 18, formed on the ends, respectively, of the bushing 15 and barrel 11 sliding over one another as the bushing is turned into the barrel to where the bore side of the steps are tightly fitted together, as shown in FIG. 1. To prove a uniform turning of the bushing so as not to bind or cross thread that bushing into the barrel receiving bore, the threads of the barrel 11, the frame 10 barrel-receiving bore 13, the bushing 15, the sleeve internal threads 30 and the screw threads 29 are the same threads. Preferably a standard thread, that is typically used on revolver barrels and barrel receiving bores, is utilized as the one thread.

The removal of the bushing 15 out from the barrel-receiving bore 13 is like the above procedure. With cylinder and bushing bevel gears meshed together, the screw is turned in the sleeve to where the screw head engages the firing pin side of the frame cylinder compartment, the screw and sleeve extending across the frame cylinder compartment. Whereafter, with the screw cylindrical head held in place turning the screw threads turns the bushing out of the frame barrel receiving bore.

Although a preferred embodiment of my invention as presently contemplated has been set out herein as the best mode of carrying out the invention, it is to be understood that the present disclosure is made by way of example only and that variations are possible without departing from the subject matter coming within the scope of the following claims and reasonable equivalency thereof, which subject matter I regard as my invention.

I claim:

1. A barrel forcing cone bushing and tooling for a weapon of a type having a barrel with a threaded throat or lead end for turning in a tapped barrel-receiving bore of the weapon frame, the improvement comprising, an annular bushing having a cylindrical shape with a smooth central opening therethrough for coaxial alignment to a bore of said barrel and is externally threaded; and means for turning said bushing into a tapped barrel-receiving bore of the weapon frame into engagement with a throat or lead end of the barrel that consists of a coupling means formed around a cylinder side end of said bushing and a turning tool means having a coupling means to couple to said bushing coupling means and means for turning said turning tool means to turn also said bushing.

2. A barrel forcing cone bushing and tooling as claimed in claim 1, wherein the bushing is made of a heat and erosion resistant material so as to be more resistant to gas erosion due to high pressure gases than is the material of the barrel; and the bushing coupling means is a bevel gear means for meshing with the coupling means of the turning tool means that is also a bevel gear means, which said turning tool means is a sleeve that is internally longitudinally threaded with said bevel gear means formed around one open end thereof, the opposite sleeve end to receive a screw means turned into a longitudinally internal thread cavity therein, said sleeve and screw means arranged to be turned separately.

3. A barrel forcing cone bushing and tooling as claimed in claim 2, wherein the frame tapped barrel-receiving bore, the threaded barrel throat or lead end, the bushing, the sleeve, and the screw means all have the same threads.

4. A barrel forcing cone bushing as claimed in claim 2, wherein the bushing bevel gear means is formed around the cylinder side end of the bushing, and slopes away from the end from the bore outwardly to the bushing threads; and the sleeve bevel gear means is inset around the sleeve and slopes inwardly oppositely to the slope of the bushing bevel gear means.

5. A barrel forcing cone bushing and tooling as claimed in claim 2, wherein the throat or lead end of the barrel and bushing barrel end are oppositely stepped, the horizontal portions of said steps to slide over one another, and the step vertical walls adjacent the barrel bore to engage and tightly seal against one another.

6. A barrel forcing cone bushing and tooling as claimed in claim 2, wherein the screw means has a wide cylindrical head with a flat top surface and a cylindrical threaded body.

7. A barrel forcing cone bushing and tooling as claimed in claim 6, wherein the sleeve and screw means head are each holed lateral, for receiving a bar means for fitting therein to individual turn either said sleeve or screw means.

* * * * *